US006375579B1

(12) United States Patent
Hart

(10) Patent No.: US 6,375,579 B1
(45) Date of Patent: Apr. 23, 2002

(54) GOLF SWING ANALYSIS SYSTEM AND METHOD

(76) Inventor: Lee David Hart, 615 Glen Grove La., Orlando, FL (US) 32839

( * ) Notice: Subject to any disclaimer, the term of this patent is extended or adjusted under 35 U.S.C. 154(b) by 0 days.

(21) Appl. No.: 09/280,386

(22) Filed: Mar. 29, 1999

Related U.S. Application Data

(60) Provisional application No. 60/079,838, filed on Mar. 30, 1998.

(51) Int. Cl.[7] ..... A63B 69/36

(52) U.S. Cl. ..... 473/131; 473/219

(58) Field of Search ..... 473/131, 140, 473/151, 152, 156, 158, 192, 220, 221, 222, 245, 246, 257, 325, 258; 434/247, 252

(56) References Cited

U.S. PATENT DOCUMENTS

| | | | | |
|---|---|---|---|---|
| 3,895,366 A | * | 7/1975 | Morris | 340/207 R |
| 3,945,646 A | | 3/1976 | Hammond | |
| 4,137,566 A | * | 1/1979 | Haas et al. | 364/410 |
| 4,155,555 A | | 5/1979 | Fink | |
| 4,251,077 A | | 2/1981 | Pelz et al. | |
| 4,254,956 A | | 3/1981 | Rusnak | |
| 4,304,406 A | | 12/1981 | Cromarty | |
| 4,341,384 A | | 7/1982 | Thackrey | |
| 4,615,526 A | | 10/1986 | Yasuda et al. | |
| 4,858,934 A | * | 8/1989 | Ladick et al. | 273/186 A |
| 4,958,836 A | | 9/1990 | Onozuka et al. | |
| 4,971,325 A | | 11/1990 | Lipps | |
| 4,979,745 A | | 12/1990 | Kobayashi | |
| 5,419,562 A | | 5/1995 | Cromarty | |
| 5,435,547 A | | 7/1995 | Lee | |
| 5,501,463 A | | 3/1996 | Gobush et al. | |
| 5,614,823 A | | 3/1997 | Katayama et al. | |
| 5,638,300 A | | 6/1997 | Johnson | |
| 5,685,782 A | | 11/1997 | Lipps et al. | |
| 5,907,819 A | * | 5/1999 | Johnson | 702/152 |
| 6,095,928 A | * | 8/2000 | Goszyk | 473/222 |

FOREIGN PATENT DOCUMENTS

| | | |
|---|---|---|
| EP | 0 340 936 | 11/1989 |

* cited by examiner

*Primary Examiner*—Jessica J. Harrison
*Assistant Examiner*—Kim T. Nguyen
(74) *Attorney, Agent, or Firm*—Allen, Dyer, Doppelt, Milbrath & Gilchrist, P.A.

(57) ABSTRACT

A dynamic laser based golf swing analysis system includes single and multiple laser sources which broadcast a monochromatic laser light projected through a cylindrical lens system to generate a series of light planes in space. An optical receiver system carried by the club shaft includes multiple optical sensors arranged in a specific three dimensional geometrical configuration such that passage of the optical receiver through the planes of laser light will produce direction and magnitude coordinates for all six degrees of freedom of the golf club head as it moves through a golf ball impact zone. The receiver transmits timing data via radio frequency to a base unit which interprets the information and displays the location coordinates, angular orientation, and velocities descriptive of the club head motion.

71 Claims, 7 Drawing Sheets

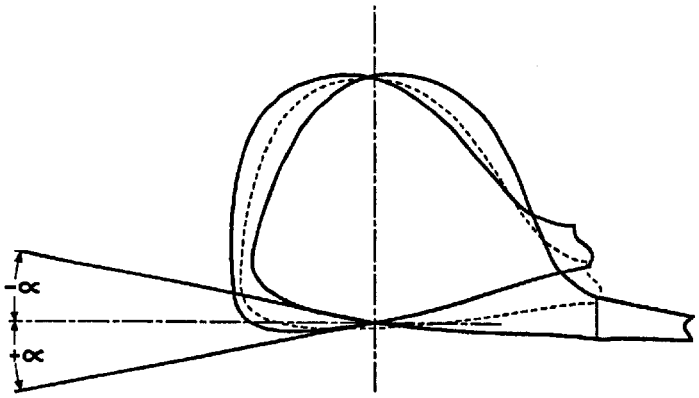
FIG. 8.
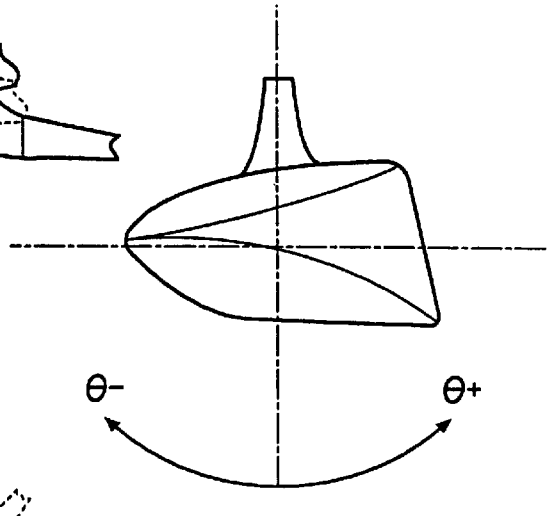
FIG. 9.
FIG. 10.
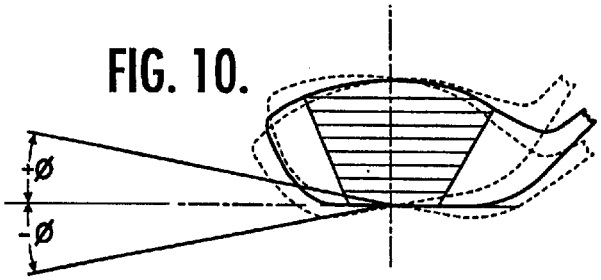
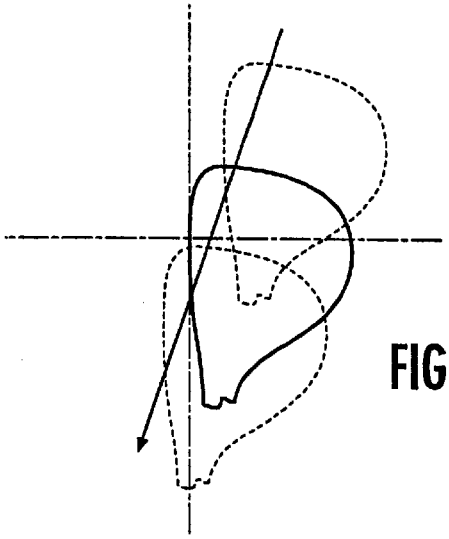
FIG. 11.
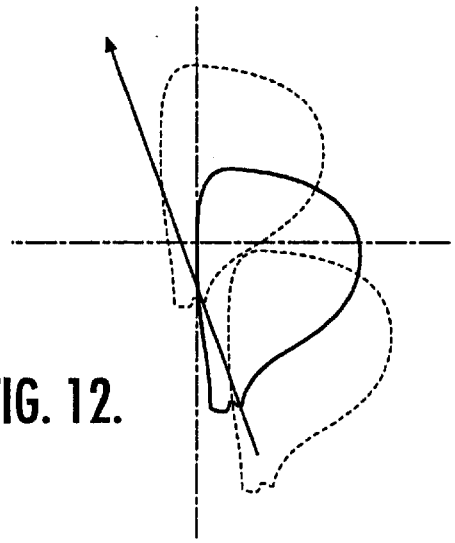
FIG. 12.

GOLF SWING ANALYSIS SYSTEM AND METHOD

CROSS REFERENCE TO RELATED APPLICATION

This application is related to and claims priority from Provisional Application Ser. No. 60/079,838 filed on Mar. 30, 1998 for a "Golf Swing Analysis and Method."

FIELD OF THE INVENTION

The invention relates to an electronic system and method for the analysis of a golf swing, and in particular to quantifying the position, orientation, and velocity of the golf club as it moves through the golf ball impact zone.

BACKGROUND OF THE INVENTION

The dynamics of a golf swing are the contributing factors, which when coupled with the club face construction and the surface characteristics of a golf ball, will ultimately determine the trajectory of the golf ball. The relative motion and orientation of the golf club head and, in particular, its face as it impacts the golf ball determines the effective transfer of energy from the club to the ball. Subtle changes to certain components of the golf swing can have dramatic effects on the flight of the golf ball, some desirable, a majority typically undesirable. It is known in the art to provide a quantifying of the relative motion of the golf club head as it impacts the golf ball through the use of multiple video cameras and extensive, costly digital image processing. By way of example, U.S. Pat. No. 5,501,463 to Gobush et al. discloses a video image processing system that uses cameras for viewing light patterns on the club. The light patterns are then processed by a computer for determining a movement of the golf club. Other methods using magnetic, optical, and mechanical techniques typically only provide a limited amount of information regarding various aspects of the club head such as speed, face angle or slice. U.S. Pat. No. 4,979,745 to Kobayashi discloses the use of a sensor in the club head which detects light from a ground station emitter. The detection then causes an emitter in the club head to emit light. A measurement of time between peak light outputs provides a timing measure from which an angle and club head speed is determined. Yet another approach includes the use of sensors placed on the ground under a ball for detecting the shadow of the club head as it passes over the sensor. The timing differences between sensor detection of a shadow are used to determine club head speed and acceleration. In a similar manner, sensors are positioned to measure the heel and toe portion of the head for determining an angular component of the swing. Many approaches require sensor loops, reflective optics and other such devices that are cumbersome and thus obstruct the club swing, limit access to the golf ball, or require such extensive setup that they become impractical for use by the average golfer. There is a need to measure the characteristics of the golf swing without devices or techniques that are complex, costly, and or limited effectiveness.

SUMMARY OF THE INVENTION

In view of the foregoing background, it is therefore an object of the invention to provide a system and method for analyzing a golf swing by quantifying a complete characterization of a golf club head movement as it passes through the impact zone of the golf ball. It is further an object of the invention to provide location coordinates, angular orientation, and velocities descriptive of the golf club head motion. It is yet another object of the invention to provide a system and method for measuring the club face loft angle, club face opening angle, club face toe-heel angle, slice magnitude, hook magnitude, chop direction and magnitude, club head height and lateral position relative to the ball both of which define the club head "sweet spot," and club head velocity.

These and other objects, advantages, and features of the present invention are provided by a golf swing analysis system comprising a radiation source for providing a plane of radiation through which radiation plane a golf club can pass, a radiation sensor carried by the golf club, which sensor is responsive to an orientation of a ball striking face of a golf club head, timing means operable with the radiation sensor for receiving a radiation sensing signal and for determining a time period between passage of the first and second portions of the head through the radiation plane, and processing means for processing the time period and calculating a characteristic value for club head movement through a ball impact zone. The radiation sensor provides the radiation sensing signals in response to first and second portions of the golf club head passing through the plane of radiation. The timing means receive the radiation sensing signals for determining a time period between signals and thus between the passage of the first and second portions. In one embodiment of the present invention, communication means are operable between the timing means and processing means for providing the processing means at a location removed from the golf club.

In a preferred embodiment of the present invention, the radiation source provides a fan shaped laser beam generally perpendicular to the surface upon which a player stands for swinging the golf club. Preferably, the laser beam extends from the player to a golf ball to be struck, and is perpendicular to a target line passing through the club face and the golf ball toward a target. Further, the radiation sensor comprises a radiation receiver having a plurality of radiation sensors orthogonally arranged at measurable preselected locations with at least three of the plurality of radiation sensors for defining a radiation sensor plane. The radiation sensor plane is representative of the striking face of the club head. Each radiation sensor comprises an optical sensor responsive to a laser beam.

A preferred embodiment of the timing means comprises a trigger input module and a counter. The trigger input module receives the detection signal from the radiation sensor and provides a pulsed output indicative of the time period between passage of the first and second locations passing the radiation plane. The counter operates with the trigger module for receiving the pulsed output and counting a number of pulses between the radiation sensor signals.

The characteristic value for club head movement comprises loft angle, face angle, and golf club head velocity. With the radiation plane comprising first and second fan shaped laser beams intersecting each other and each vertically orientated and arranged at a measurable fixed angle to each other, and with the first fan shaped laser beam perpendicular to a target line passing through the club face and ball, the characteristics value comprises loft angle, face angle, toe-heel angle, slice velocity, hook velocity, and golf club head velocity. With the radiation plane comprising first, second, and third planar shaped laser beams intersecting each other, the characteristic value for club head movement comprises loft angle, face angle, toe-heel angle, slice velocity, hook velocity, chop velocity, golf club head velocity, and sweet spot. Here, the first and second planar shaped laser beams are vertically orientated, intersecting, and arranged at a measurable fixed angle to each other. The first planar shaped laser beam is perpendicular to a target line passing through the club face and ball, and the third planar shaped laser beam intersects the first and second planar shaped laser beams at a non-vertical angle.

Included in a preferred embodiment of the present invention herein describes is a laser module base unit consisting of three laser sources. Each laser source is coupled to a cylindrical lens assembly for the projection of a plane of laser light. The laser sources are oriented in a specific geometrical alignment to provide three intersecting planes of laser light at predetermined angles. The base unit containing the laser sources is positioned on the ground between the golfer and golf ball with the lasers directed toward the golf ball. The sensor module is clipped to the shaft of the golf club just above the club head and contains four sensors in a three dimensional, orthogonal pattern with predetermined distances between each sensor. The sensors contained in the sensor module trigger the system counter upon intersection with the planes of laser light. The relative counts are stored in a data queue and then transmitted via radio frequency to the base unit containing the laser source module and a microprocessor which calculates the club head location coordinates, angles and velocities at the point of impact with the golf ball.

BRIEF DESCRIPTION OF DRAWINGS

A preferred embodiment of the invention as well as alternate embodiments are described by way of example with reference to the accompanying drawings in which:

FIGS. 8–16 illustrate characteristic values for a golf club head movement including face angle, loft angle, toe-heel angle, slice, hook, lateral position, positive chop, negative chop, and head height, respectively.

DETAILED DESCRIPTION OF PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 2:
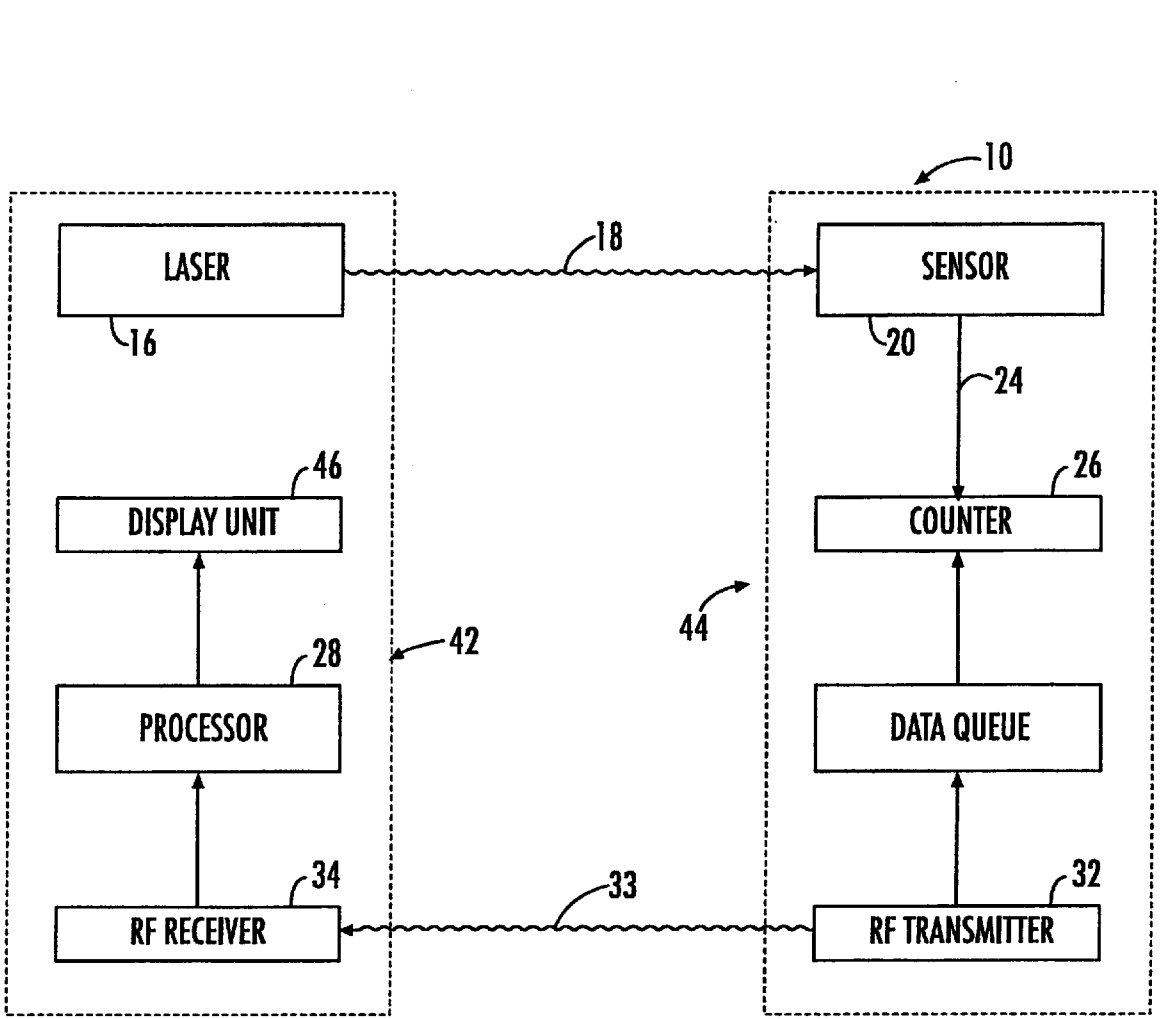
FIG. 2 is a block diagram illustrating functional elements in one preferred embodiment of the golf swing analysis system of the present invention.
Figure 1:
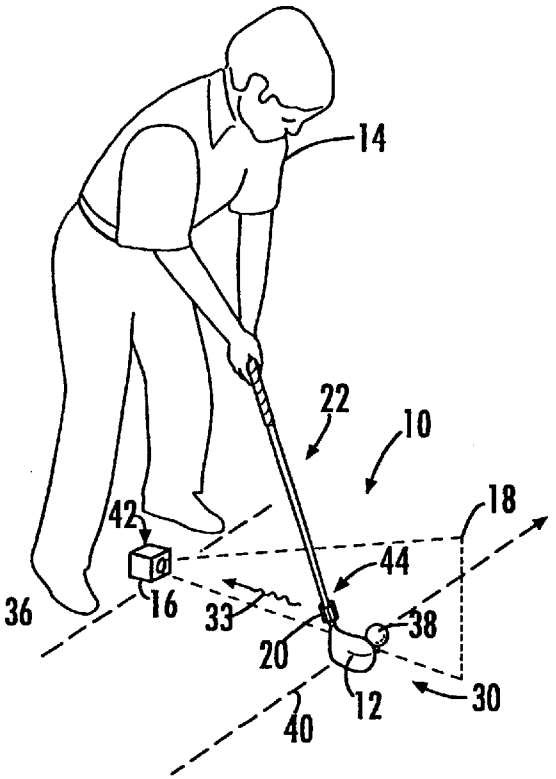
FIG. 1 is a perspective view of a golf swing analysis system of the present invention illustrating a use by a player.

Referring initially to FIGS. 1 and 2, a preferred embodiment of the present invention, a golf swing analysis system 10 useful in determining movement of a golf club head 12 during the execution of a golf swing by a player 14 comprises a laser source 16 for providing a plane shaped laser beam 18 through which beam the golf club head can pass. An optical sensor 20 is carried by a golf club 22. The optical sensor 20 is responsive to an orientation of the club head 12 for providing a sensing signal 24, responsive to portions of the club head passing through the laser beam 18, as will be further detailed later in this section. As illustrated with reference to FIG. 2, a counter 26, operable with the optical sensor 20, receives the sensing signals 24 and defines a time period between passage of first and second portions of the club head 12 through the plane shaped laser beam 18. As will be further described later in this section, a processor 28 processes the time period and calculates a characteristic value for club head movement through a ball impact zone.

The system 10, in the embodiment herein described, further includes communication means comprising an RF transmitter 32 operable with the counter 26 for transmitting 33 data collected to a remote RF receiver 34 operable with processor 28.

As illustrated again with reference to FIG. 1, the plane shaped laser beam 18 is perpendicular to the ground surface 36 upon which the player 14 stands for swinging the golf club 22. Further, the laser beam 18 preferably extends from the player 14 toward a golf ball 38 to be struck, and is at a right angle to a target line 40 which passes through the club head 12 and the golf ball 38 toward a target, such as a golf course green. In a preferred embodiment, a base unit 42 carries the laser source 16, RF receiver 34, and processor 28. The optical sensor 20, counter 26, and RF transmitter 32 are carried by the golf club 22 in a sensor module 44. A display 46 is also carried in the base unit 42, as illustrated again with reference to FIG. 2.

Figure 3:
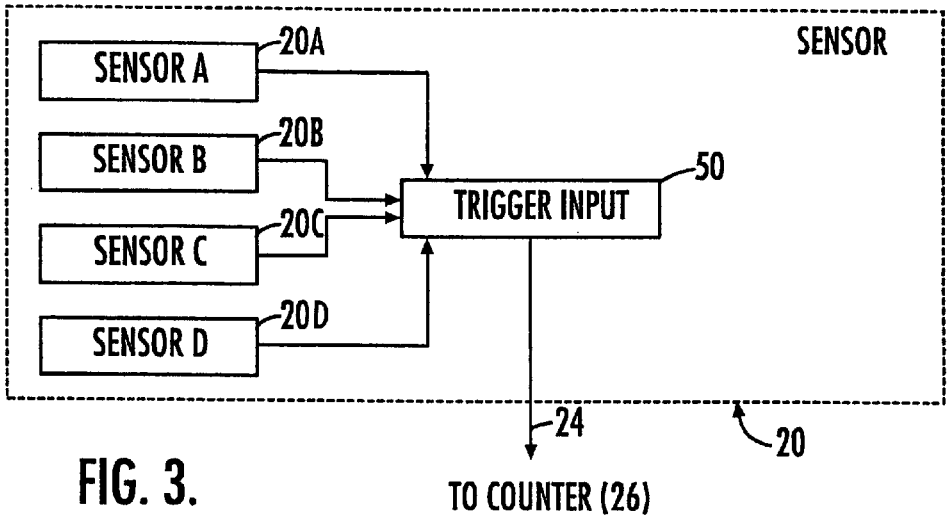
FIG. 3 is a functional block diagram illustrating a sensor embodiment of FIG. 2.
Figure 4:
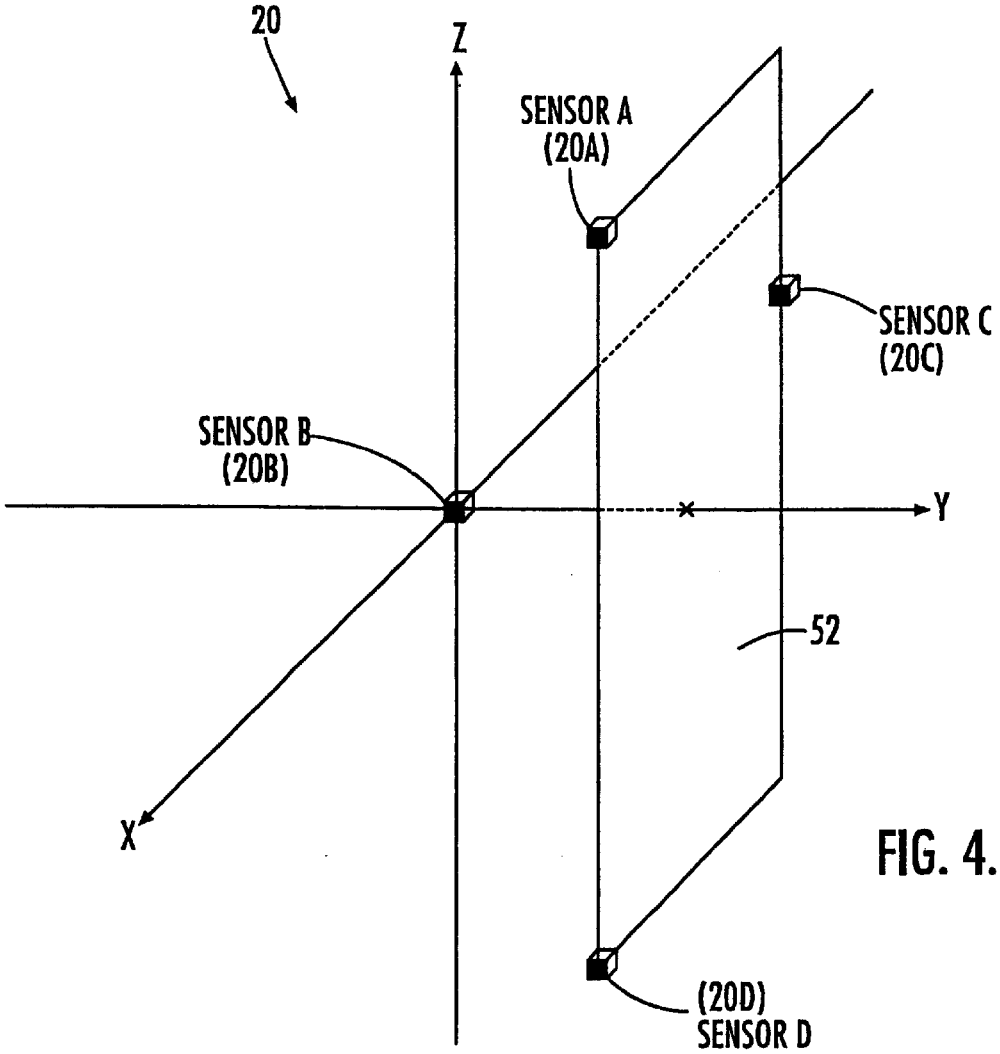
FIG. 4 is an orthogonal coordinate system illustrating its use in defining a sensor plane of the present invention.

As illustrated with reference to FIG. 3, the optical sensor 20 comprises an optical receiver 48 having a four (A, B, C, D) optical sensors 20A, 20B, 20C, and 20D, each providing a trigger input 50 to the counter 26. As illustrated with reference to FIG. 4, the sensors 20, identified for convenience as A, B, C, and D, are orthogonally arranged at measurable preselected locations X, Y, Z within the orthogonal coordinate system with three sensors 20A, 20C, and 20D, by way of example, lying within and thus defining a sensor plane 52. The sensor plane 52 is oriented so as to be representative of the striking face on the club head 12.

In a preferred embodiment of the present invention, timing means include the counter 26 which receives the trigger input 50 each time any one of the sensors 20A, 20B, 20C, or 20D, passes through the plane shaped laser beam 18. Timing pulses from the counter 26 are interrupted, and a pulse count or count value from the counter is then stored in a data queue 54 until the swing is complete. Once the swing is complete, count data is fed to the RF transmitter 32 which in turn transmits this data to the RF receiver 34 carried within the base unit 42. The data representative of count value is then passed to the arithmetic processor 28 for reduction. The arithmetic processor 28 calculates the position, angular orientation, and velocities of the club head 12 at the point of impact with the ball 38. These values are then sent to the display 46 for viewing.

Figure 5A:
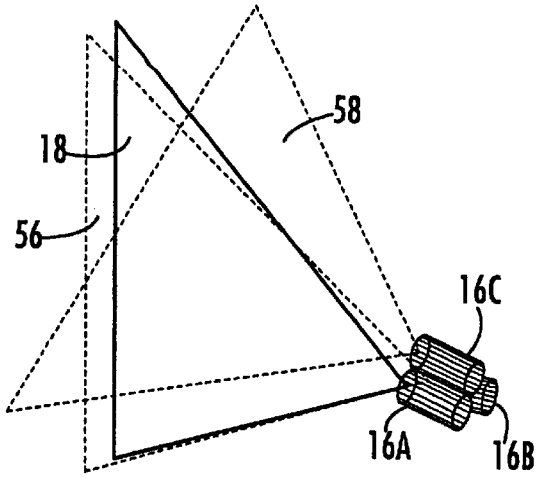
FIGS. 5A, 5B, and 5C are perspective, elevation, and plan views of multiple laser sources and their respective planar beams used in an alternate embodiment of the present invention.
Figure 5C:
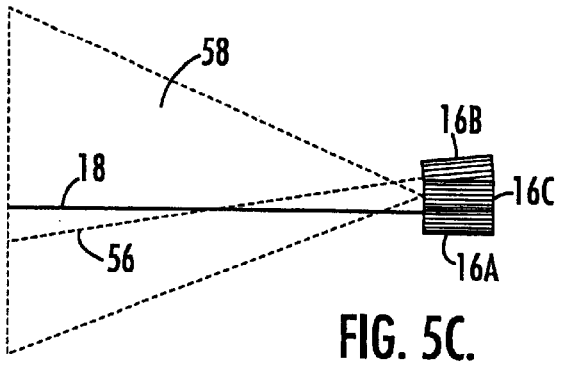
Figure 5B:
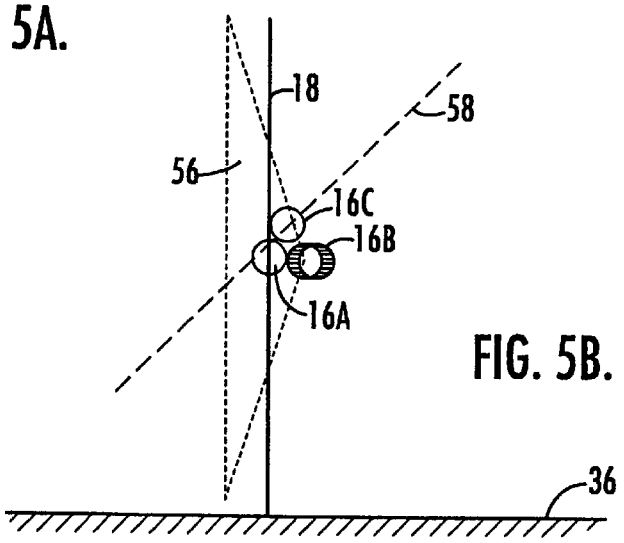

With the embodiment as described with reference to FIGS. 1–4, the characteristic values for club head movement can include loft angle, face angle, and golf club head velocity. In an alternate embodiment, a second planar shaped laser beam 56 is provided, wherein the first beam 18 (earlier described) and this second 56 fan shaped laser beam, as illustrated with reference to FIGS. 5A, 5B, and 5C, intersect each other and each are vertically orientated and arranged at a measurable fixed angle to each other. As earlier described with reference to FIG. 1, first laser beam 18 is perpendicular to the target line 40. With the use of two laser beams 18, 56, the characteristic values available increase over that earlier described. They will now includes loft angle, face angle, toe-heel angle, slice velocity, hook velocity, and golf club head velocity. In yet another embodiment including the first 18, the second 56, and a third 58 planar shaped laser beam, each intersecting each other, with the first and second vertically orientated, intersecting, and arranged at a measurable fixed angle to each other, the first beam perpendicular to a target line 40, and the third planar shaped laser beam intersecting the first and second beams at a non-vertical angle, as illustrated again with reference to FIGS. 5A, 5B, and 5C. With such a three beam arrangement, the characteristic values available include loft angle, face angle, toe-heel angle, slice velocity, hook velocity, chop velocity, golf club head velocity, and sweet spot.

Figure 6:
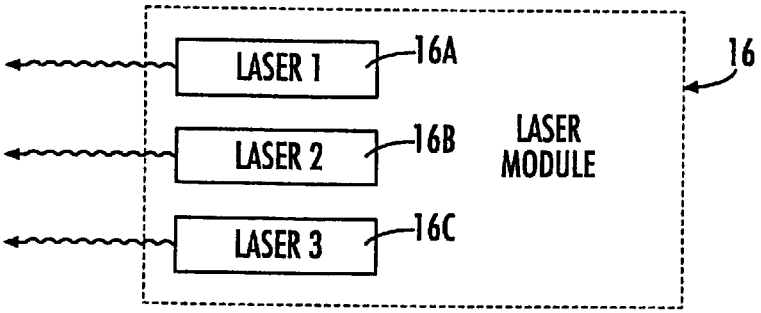
FIG. 6 is a functional block diagram illustrating one embodiment of the laser source configuration of FIGS. 5A–5C.

As illustrated with reference to FIG. 6 and again to FIG. 2, the laser source 16, a laser module includes three separate laser sources 16A, 16B, 16C which are conveniently housed in the base unit 42 for the preferred embodiment herein described. As herein described, each laser broadcasts a plane of light at a predetermined angle relative to each other. With regard to the orientation of the laser beams 18, 56, and 58, described with reference again to FIGS. 5A, 5B, and 5C, the relative angles between the laser beam planes are also arbitrary but must be known a priory. As earlier described, the first plane shaped laser beam 18 is projected as a vertical plane of light with respect to the ground surface 36. The second laser beam 56 is also projected as a vertical plane of light but at an intersecting angle with the first beam 18. The third planar beam 58 intersects the first 18 and second 56 and is at a non-vertical angle with respect to the ground surface 36.

The specific sensor geometry for one preferred system includes a spacing of the sensors 20 selected for desired aesthetic characteristics while optimizing the overall system performance. However, their arrangement may be arbitrary as long as the exact values of the distance between sensors 20 is known. By way of example, and as illustrated again with reference to FIG. 4, Sensors 20A, 20C, and 20D are located in a single plane which defines the sensor plane 52, with sensor 20B along a line orthogonal to the plane 52. The sensor geometry for all four sensors 20 are illustrated with reference to FIGS. 7A, 7B, and 7C. The location of Sensor 20B is chosen as the origin of the orthogonal coordinate axis.

The exact sensor position values (X, Y Z) and their offset from reference sensor 20B in the selected coordinate space is determined during the manufacturing phase of the system. These values are calibrated and stored as arithmetic constants and are used by the arithmetic processor 28. Using sensor 20B as the origin of the three dimensional coordinate structure, the calibrated values for the remaining sensors are as follows:

Sensor A (20A): $A_x$, $A_y$, $A_z$,

Sensor C (20C): $C_x$, $C_y$, $C_z$,

Sensor D (20D): $D_x$, $D_y$, $D_z$,

The measured quantities during the swing are the relative counts (from the counter 26) between the intersection of each sensor with each plane of laser light. Using planar laser beam 18 as illustrated with reference again to FIGS. 5A–5C, the measured values take the form of:

$$t_{a1}, t_{c1}, t_{d1}$$

where t represents the count value, and a, c, d indicates the respective sensor and 1 represents the first laser plane i.e. laser plane 18.

Figure 7A:
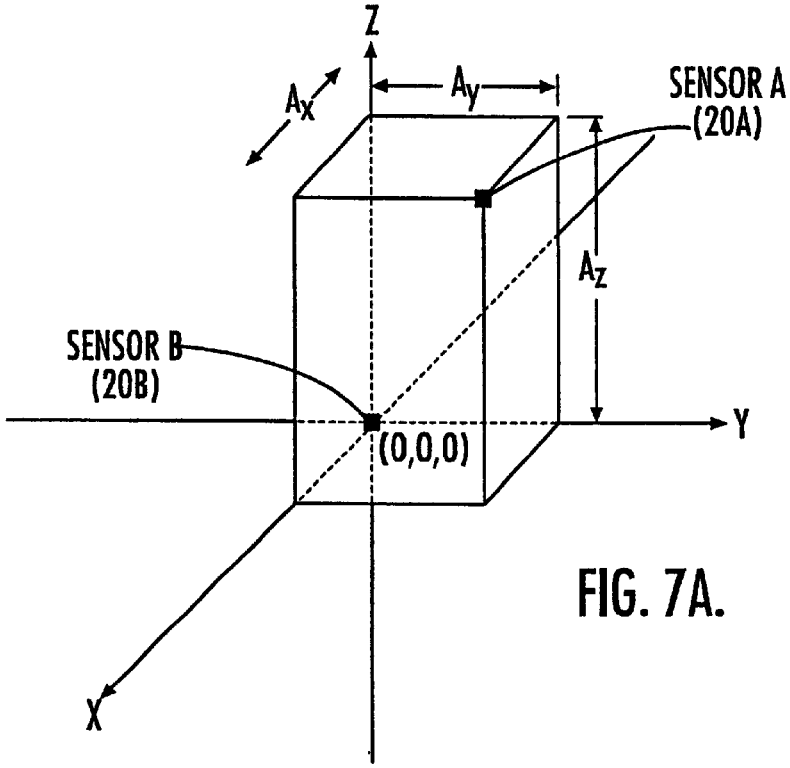
FIGS. 7A, 7B, and 7C illustrate one embodiment of a sensor geometrical configuration as described in an orthogonal coordinate system.
Figure 7B:
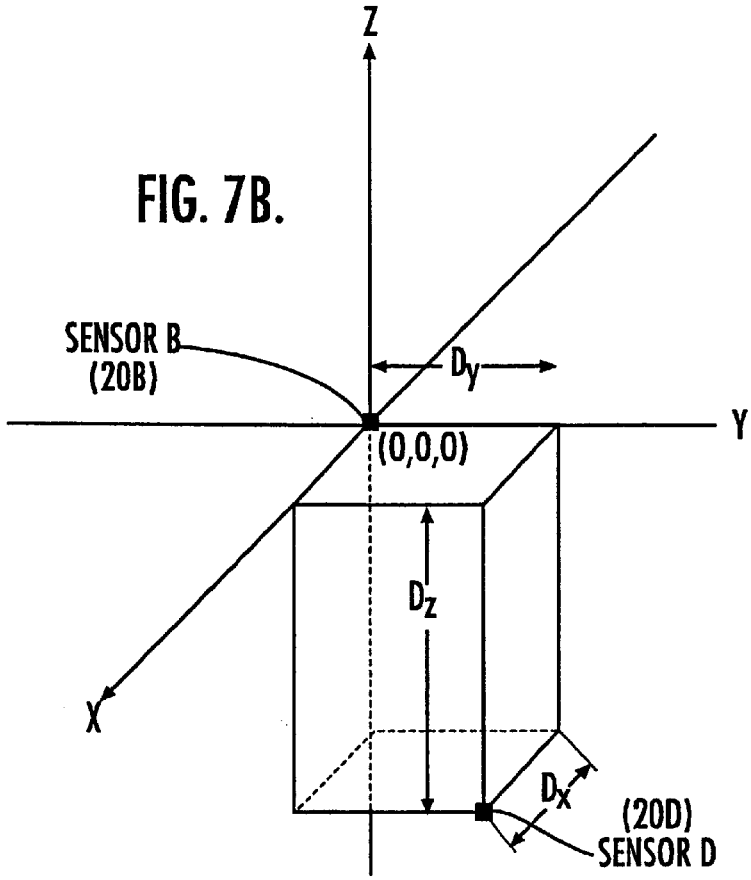
Figure 7C:
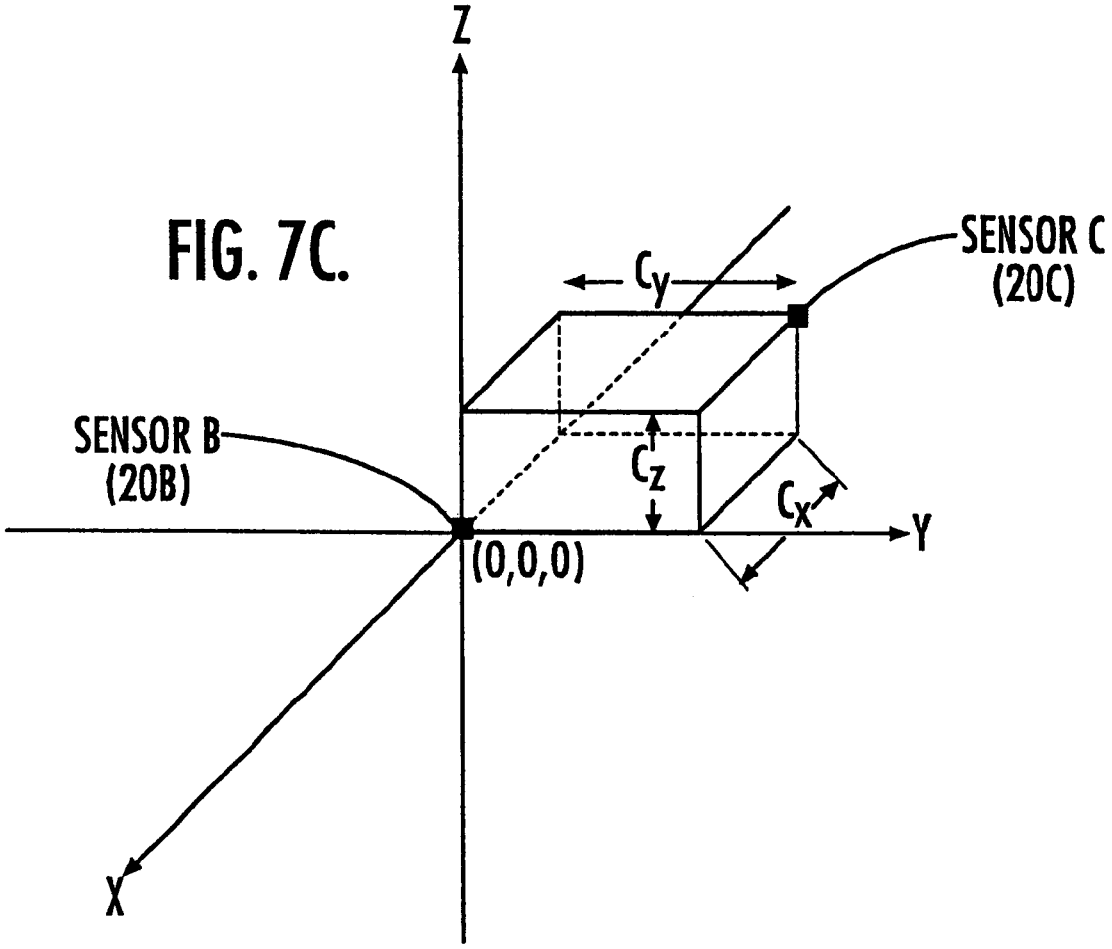

Given the geometry as earlier described with reference to FIGS. 7A–7C, for the sensors 20, the mathematical equation for the calculation of the club face angle as defined in FIG. 8 can be reduced to the following expression.

$$\alpha = \tan^{-1}\left[\frac{(t_{a1}D_z - t_{d1}A_z)(A_yC_z - C_yA_z) - (t_{a1}C_z - t_{c1}A_z)(A_yD_z - D_yA_z)}{(t_{a1}C_z - t_{c1}A_z)(A_xD_z - D_xA_z) - (t_{a1}D_z - t_{d1}A_z)(A_xC_z - C_xA_z)}\right]$$

Once this parameter has been determined, the loft angle as defined in FIG. 9, may also be calculated using the following expression along with the measured values described above:

$$\theta = \tan^{-1}\left[\frac{(t_{a1}D_x - t_{d1}A_x)\sin\alpha - (t_{a1}D_y - t_{d1}A_y)\cos\alpha}{(t_{d1}A_z - t_{a1}D_z)}\right]$$

The club head velocity may also be calculated using the above values in the following expression:

$$S_y = \left[\frac{c_{y1}}{t_{c1}}\right]$$

where the term $c_{y1}$ is calculated using the following equation:

$$C_{y1}=C_x \cos\theta \sin\alpha + C_y \cos\theta \cos\alpha + C_z \sin\theta_{51}$$

Using the second planar laser beam 56 created by laser 16B as illustrated with reference again to FIGS. 5A–5C, and the previously calculated values for the angles α, and θ, the toe-heel angle φ, as defined in FIG. 10, can be determined using the following expression:

$$\phi = \tan^{-1}\left[\frac{b_3}{a_3}\right] - \cos^{-1}\left[\frac{c_3}{\sqrt{a_3^2 + b_3^2}}\right]$$

where $$a_3=a_1(t_{c2}-t_{b2})-C_1(t_{a2}-t_{b2})$$

$$b_3=a_2(t_{c2}-t_{b2})-C_2(t_{a2}-t_{b2})$$

$$c_3=M[a_{y1}(t_{c2}-t_{b2})-C_{y1}(t_{a2}-t_{b2})]$$

and $$a_1=A_x \cos\alpha - A_y \sin\alpha$$

$$c_1=C_x \cos\alpha - C_y \sin\alpha$$

$$a_2=-A_x \sin\theta \sin\alpha - A_y \sin\theta \cos\alpha + A_z \cos\theta$$

$$c_2=-C_x \sin\theta \sin\alpha - C_y \sin\theta \cos\alpha + C_z \cos\theta$$

and where M is slope of planar laser beam 56 with respect to the Y axis coordinate of the sensors 20.

The measured values take the form of:

$$t_{a2,\ tc2}, t_{d2}$$

where t represents the count value, and a, c, d indicates the respective sensor and 2 represents the second laser plane 56.

Using the value for the toe-heel angle $\phi$, calculated above, plus the previously calculated values for the angles $\alpha$, and $\theta$, and the club head velocity value $S_y$ the magnitude for the slice and hook component of the swing as shown in FIGS. 11 and 12, respectively, can be determined with the following expression:

$$S_x = \left[\frac{M * S_y(t_{c2} - t_{b2}) + (M * c_{y1}) - c_{x1}}{(t_{c2} - t_{b2})}\right]$$

where $$c_{x1}=c_1 \cos \phi + c_2 \sin \phi$$

$$c_{y1}=C_x \cos \theta \sin \theta + C_y \cos \theta \cos \alpha + C_z \sin \theta$$

and $$c_1=C_x \cos - C_y \sin \alpha$$

$$c_2=-C_x \sin \theta \sin a - C_y \sin \theta \cos \alpha + C_z \cos \theta$$

and where M is slope of laser plane B with respect to the Y axis coordinate of the sensors 20.

The measured values take the form of:

$$t_{c2}, t_{b2}$$

where t represents the count value, and c, b indicates the respective sensor and 2 represents the second planar laser beam 56.

Figure 13:
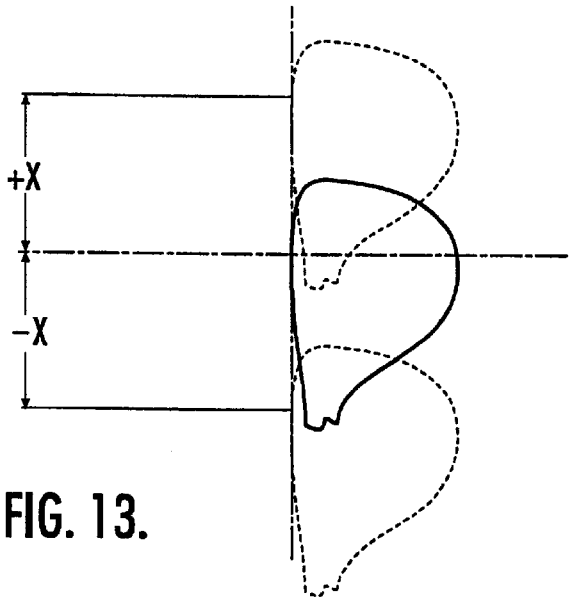

Using the above calculated value for the slice or hook velocity, plus the club head velocity, the value for the club head translation with respect to the ball as illustrated with reference to FIG. 13, can be calculated using the following equation:

$$X=(S_x - M*S_y)*t_{b2}$$

where M is slope of laser plane B and $t_{b2}$is the same measured quantity used in the previous expression above.

Figure 14:
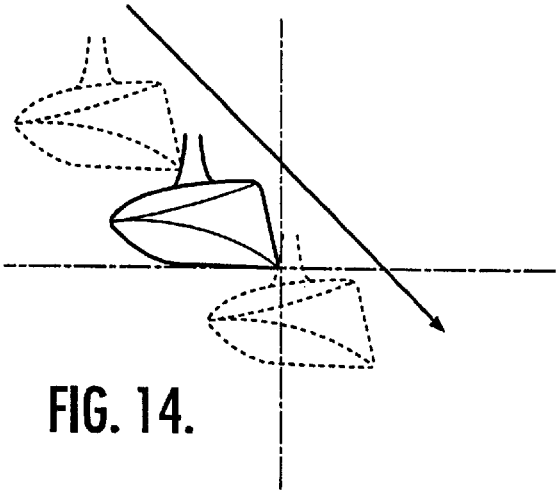
Figure 15:
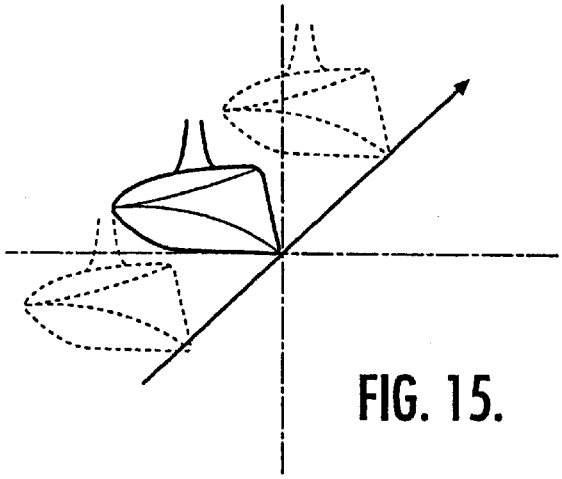

Adding the third planar laser beam 58 created by laser source 16C, and using the previously calculated values for the angles $\alpha$, $\theta$, $\phi$, and the club head velocity value $S_y$ the direction and magnitude for the chop component of the swing as shown in FIGS. 14 and 15, can be determined using the following expression:

$$S_z = \left[\frac{Q * S_y(t_{c3} - t_{b3}) + (Q * c_{y1}) - c_{z1}}{(t_{c3} - t_{b3})}\right]$$

where $$c_{y1}=C_x \cos \theta \sin \alpha + C_y \cos \alpha \cos \alpha + C_z \sin \theta$$

$$c_{z1}=c_2 \cos \phi - c_1 \sin \phi$$

and $$c_1=C_x \cos \alpha - C_y \sin \alpha$$

$$c_2 - C_x \sin \theta \sin \alpha - C_y \sin \theta \cos \alpha + C_z \cos \theta$$

and where Q is slope of the third planar laser beam 58 with respect to the Y axis coordinate of the sensors 20.

The measured values take the form of:

$$t_{c3}, t_{b3}$$

where t represents the count value, and c, b indicates the respective sensor and 3 represents the third laser plane i.e. laser plane.

Figure 16:
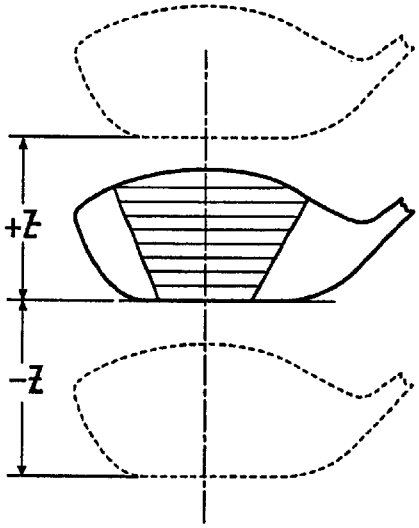

Using the above calculated value for the chop direction and magnitude, plus the club head velocity, the value for the club head height translation with respect to the ground as shown in FIG. 16, can be calculated using the following equation:

$$Z=(S_z - Q*S_y)*t_{b3}$$

where Q is slope of laser plane C and $t_{b3}$ is the same measured quantity used in the previous expression above.

The absolute quantities for the motion of the golf club head can be determined with the above derivations provided accurate positions for the source lasers is known. What is more desirable for the devices intended use is to determine the relative position and motion of the club head in relation to the golf ball. This is done by taking data during the back swing as the club moves away from the ball and using these results as a reference for the forward swing.

The derivations above are for a general case of sensor geometry. The sensor geometry can be selected to be a variety of orientations some of which can simplify the required calculations other orientations may provide more condensed packaging. The overall application determines the optimal sensor construction since the basic concept can be employed to measure the motion of almost any moving object. A wider sensor spacing provides greater system accuracy but the calculations remain the same.

A prototype system was constructed using the following sensor spacing:

Sensor A: $A_x$=0.250
$A_y$=0
$A_z$=0.250
Sensor C: $C_x$=−0.100
$C_y$=0.100
$C_z$=0
Sensor D: $D_x$=0.250
$D_y$=100
$D_z$=−0.250

Units are in inches. The respective resolution of the system for the angles $\alpha$ and $\theta$ was 0.1 degrees. For the angle $\phi$, the resolution was 0.3 degrees. The velocities $S_x$, $S_y$, $S_z$ had a resolution of 0.01 mph. The lateral and height components had a calculated resolution of 0.1 inches.

In summary, operation includes the sensor module 44 which is attached to the golf club shaft just above the interface between the club shaft and the club head 12. The base unit 42 which contains the laser sources 16 is positioned on the ground surface 36 between player/golfer 14 and the golf ball 38 with the laser beam 18 directed toward the golf ball. During a swing, the golf club moves through the various planes of laser beams 18, 56, 58 as above described, which beams are detected by the sensors 20. Data is transmitted to the base unit 42, which calculates and displays the club head position, orientation and velocity relative to the golf ball at the point of impact with the golf ball.

As described, the system 10 herein described uses a set of laser sources positioned to illuminate the impact zone 30 preceding the ball 38. By way of example, positioning the sensor plane 52 between the ball 38 and laser plane 18 at address, an initial setting is completed during the back swing. Measurements are then made from the initial setting as the plane 52 passes through the plane 18 during the down swing. The basic concept of the system 10 is by nature expandable to include multiple laser sources before and after the ball to provide multiple data points along additional portions of the swing path. This data can then be graphically represented via computer to give a further characterization of the swing.

Likewise, the data can be downloaded to a personal computer and used to generate a graphical representation of the club head position and orientation at the point of impact with the golf ball. The system 10 can be used indoors as well as outdoors to provide off season practice or indoor coaching. The sensor module 44 attaches to any golf club 12, and a golf ball does not need to be present for the system 10 to operate. Further, it is anticipated that training clubs will be constructed with the sensor module 44 integrally formed within the club. The data collected can also be used in conjunction with environmental data and course descriptive data to create an expert system for the proper club selection and club head speed requirements and club head angles required to achieve a desired ball trajectory.

The present invention described in this document has been constructed and demonstrated in prototype form. The system 10 herein described, provides a very cost effective way to completely and accurately characterize important features of a golf swing, and without cumbersome devices being placed in such a way as to impede the swing or being placed directly in the swing path. The system can also be easily expanded to increase over all system functionality. The devices described in this document represents a viable and demonstrable break through for the characterization and analysis of the golf swing in such a way as to be affordable and useable to the average golfer by providing information that to date has not been available by any other device or means at this level of completeness for a single swing or impact event.

It is therefore expected that many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and other embodiments are intended to be included within the scope of the appended claims.

That which is claimed is:

1. A golf swing analysis system useful in determining movement of a golf club head during the execution of a golf swing by a player, the system comprising:

a radiation source for providing a plane of radiation through which radiation plane the golf club can pass;

a plurality of radiation sensors dimensioned for carrying by a golf club, the radiation sensors responsive to an orientation of a ball striking face of a golf club head, the radiation sensors providing a radiation sensing signal responsive to first and second portions of the golf club head passing through the plane of radiation, wherein the radiation sensor comprises a radiation receiver having a plurality of radiation sensors orthogonally arranged at measurable preselected locations with at least three of the plurality of radiation sensors defining a radiation sensor plane, the radiation sensor plane representative of the striking face of the club head;

timing means operable with the radiation sensor for receiving the radiation sensing signal and for determining a time period between passage of the first and second portions of the head through the radiation plane; and processing means for processing the time period and calculating a characteristic value for club head movement through a ball impact zone.

2. The system according to claim 1, further comprising communication means operable between the timing means and processing means.

3. The system according to claim 2, wherein the communication means comprise:

a transmitter operable with the timing means for transmitting a communication signal representative of the time period; and a receiver operable with the processing means for receiving the communication signal.

4. The system according to claim 3, wherein the transmitter and receiver comprise radio frequency operation.

5. The system according to claim 1, wherein the radiation source provides a fan shaped laser beam generally perpendicular to the surface upon which a player stands for swinging the golf club.

6. The system according to claim 5, wherein the laser beam extends from the player to a golf ball to be struck, and is perpendicular to a target line passing through the club face and the golf ball toward a target.

7. The system according to claim 1, wherein each radiation sensor comprises an optical sensor responsive to a laser beam.

8. The system according to claim 1, wherein the timing means comprises:

a trigger input module for receiving the detection signal from the radiation sensor and for providing a pulsed output indicative of the time period between passage of the first and second locations passing the radiation plane;

a counter operable with the trigger module for receiving the pulsed output and counting a number of pulses between the radiation sensor signals; and a data queue operable with the counter for storing the counts from counter module for transmission to a processor.

9. The system according to claim 1, wherein the characteristic value for club head movement comprises a value selected from the group consisting of loft angle, face angle, and golf club head velocity.

10. The system according to claim 1, further comprising a display for displaying the characteristic value.

11. The system according to claim 1, further comprising a golf club having a shaft and head, the head having a ball striking face for striking a golf ball placed within a swing path of the club head.

12. The system according to claim 1, wherein the radiation plane comprises first and second fan shaped laser beams intersecting each other and each vertically orientated and arranged at a measurable fixed angle to each other, and wherein the first fan shaped laser beam is perpendicular to a target line passing through the club face and ball.

13. The system according to claim 12, wherein the characteristic value for club head movement comprises a value selected from the group consisting of loft angle, face angle, toe-heel angle, slice velocity, hook velocity, and golf club head velocity.

14. A golf swing analysis system useful in determining movement of a golf club head during the execution of a golf swing by a player, the system comprising:

a radiation source for providing a plane of radiation through which radiation plane the golf club can pass, wherein the radiation plane comprises first, second, and third planar shaped laser beams intersecting each other, the first and second vertically orientated, intersecting, and arranged at a measurable fixed angle to each other, the first planar shaped laser beam being perpendicular to a target line passing through the club face and ball, and wherein the third planar shaped laser beam intersects the first and second planar shaped laser beams at a non-vertical angle;

a radiation sensor dimensioned for carrying by a golf club, the radiation sensor responsive to an orientation of a ball striking face of a golf club head, the radiation sensor providing a radiation sensing signal responsive to first and second portions of the golf club head passing through the plane of radiation;

timing means operable with the radiation sensor for receiving the radiation sensing signal and for determining a time period between passage of the first and second portions of the head through the radiation plane; and processing means for processing the time period and calculating a characteristic value for club head movement through a ball impact zone.

15. The system according to claim 14, wherein the characteristic value for club head movement comprises a value selected from the group consisting of loft angle, face angle, toe-heel angle, slice velocity, hook velocity, chop velocity, golf club head velocity, and sweet spot.

16. A golf swing analysis system useful in determining movement of a golf club head during the execution of a golf swing by a player, the system comprising:

a golf club having a shaft and head, the head having a ball striking face for striking a golf ball placed at an impact zone within a swing path of the club head;

a radiation source providing a plane of radiation position within the impact zone, through which plane of radiation the golf club head can pass;

a radiation sensor carried by the golf club, the radiation sensor responsive to an orientation of the ball striking face of the golf club head for providing a radiation sensing signal for each of first and second portions of the ball striking face passing through the plane of radiation, wherein the radiation sensor comprises a radiation receiver having a plurality of radiation sensors orthogonally arranged at measurable preselected locations with at least three of the plurality of radiation sensors defining a radiation sensor plane, the radiation sensor plane representative of the striking face of the club head;

timing means carried by the golf club and operable with the radiation sensor for receiving the radiation sensing signals and for determining a time period between passage of the first and second portions of the ball striking face through the radiation plane;

communication means operable between the timing means and processing means; and processing means for processing the time period and calculating a characteristic value for club head movement through the impact zone.

17. The system according to claim 16, wherein the communication means comprise:

a transmitter operable with the timing means for transmitting a communication signal representative of the time period; and a receiver operable with the processing means for receiving the communication signal.

18. The system according to claim 17, wherein the transmitter and receiver comprise radio frequency operation.

19. The system according to claim 16, wherein the radiation source provides a vertically oriented fan shaped laser beam.

20. The system according to claim 19, wherein the laser beam extends from the golfer to the golf ball, and is perpendicular to a target line passing through the club face and ball toward a target to be received by the golf ball.

21. The system according to claim 18, wherein each radiation sensor comprises an optical sensor responsive to a laser beam.

22. The system according to claim 16, wherein the timing means comprises:

a trigger input module for receiving the detection signal from the radiation sensor and for providing a pulsed output indicative of the time period between passage of the first and second locations passing the radiation plane;

a counter operable with the trigger module for receiving the pulsed output and counting a number of pulses between the radiation sensor signals; and a data queue operable with the counter for storing the counts from counter module for transmission to a processor.

23. The system according to claim 16, wherein the characteristic value for club head movement comprises a value selected from the group consisting of loft angle, face angle, and golf club head velocity.

24. The system according to claim 16, further comprising a display for displaying the characteristic value.

25. The system according to claim 16, wherein the radiation plane comprises first and second fan shaped laser beams intersecting each other and each vertically orientated and arranged at a measurable fixed angle to each other, and wherein the first fan shaped laser beam is perpendicular to a target line passing through the club face and ball.

26. The system according to claim 25, wherein the characteristic value for club head movement comprises a value selected from the group consisting of loft angle, face angle, toe-heel angle, slice velocity, hook velocity, and golf club head velocity.

27. A golf swing analysis system useful in determining movement of a golf club head during the execution of a golf swing by a player, the system comprising:

a golf club having a shaft and head, the head having a ball striking face for striking a golf ball placed at an impact zone within a swing path of the club head;

a radiation source providing a plane of radiation position within the impact zone, through which plane of radiation the golf club head can pass, wherein the radiation plane comprises first, second, and third planar shaped laser beams intersecting each other, the first and second vertically orientated, intersecting, and arranged at a measurable fixed angle to each other, the first planar shaped laser beam being perpendicular to a target line passing through the club face and ball, and wherein the third planar shaped laser beam intersects the first and second planar shaped laser beams at a non-vertical angle;

a radiation sensor carried by the golf club, the radiation sensor responsive to an orientation of the ball striking face of the golf club head for providing a radiation sensing signal for each of first and second portions of the ball striking face passing through the plane of radiation;

timing means carried by the golf club and operable with the radiation sensor for receiving the radiation sensing signals and for determining a time period between passage of the first and second portions of the ball striking face through the radiation plane;

communication means operable between the timing means and processing means; and processing means for processing the time period and calculating a characteristic value for club head movement through the impact zone.

28. The system according to claim 27, wherein the characteristic value for club head movement comprises a value selected from the group consisting of loft angle, face angle, toe-heel angle, slice velocity, hook velocity, chop velocity, golf club head velocity, and sweet spot.

29. A golf swing analysis system useful in determining movement of a golf club head during the execution of a golf swing by a player, the system comprising:

a laser source for providing a plane shaped laser beam through which beam a golf club head can pass;

an optical sensor to be carried by a golf club, the optical sensor responsive to an orientation of a ball striking face of a golf club head for providing a sensing signal responsive to first and second portions of the golf club head passing through the laser beam, wherein the optical sensor comprises an optical receiver having a plurality of optical sensors orthogonally arranged at measurable preselected locations with at least three of the optical sensors lying within a sensor plane, the sensor plane representative of the striking face of the club head;

timing means operable with the optical sensor for receiving the sensing signals and for determining a time period between passage of the first and second portions of the head through the plane shaped laser beam; and processing means for processing the time period and calculating a characteristic value for club head movement through a ball impact zone.

30. The system according to claim 29, further comprising communication means operable between the timing means and processing means.

31. The system according to claim 30, wherein the communication means comprise:

a radio frequency transmitter operable with the timing means for transmitting an RF signal representative of the time period; and a radio frequency receiver operable with the processing means for receiving the RF signal.

32. The system according to claim 29, wherein the plane shaped laser beam is perpendicular to the surface upon which a player stands for swinging the golf club.

33. The system according to claim 32, wherein the laser beam extends from the player to a golf ball to be struck, and is at a right angle to a target line passing through the club face and the golf ball toward a target.

34. The system according to claim 29, wherein the timing means comprises:

a trigger input module for receiving the detection signal from the optical sensor and for providing a pulsed output during the time period between passage of the first and second locations through the plane shaped laser beam; and a counter operable with the trigger module for receiving the pulsed output and counting a number of pulses between the sensor signals.

35. The system according to claim 29, wherein the characteristic value for club head movement comprises a value selected from the group consisting of loft angle, face angle, and golf club head velocity.

36. The system according to claim 29, wherein the plane shaped laser beam comprises first and second fan shaped laser beams intersecting each other and each vertically orientated and arranged at a measurable fixed angle to each other, and wherein the first fan shaped laser beam is perpendicular to a target line passing through the club face and ball.

37. The system according to claim 36, wherein the characteristic value for club head movement comprises a value selected from the group consisting of loft angle, face angle, toe-heel angle, slice velocity, hook velocity, and golf club head velocity.

38. The system according to claim 29, wherein the plane shaped laser beam comprises first, second, and third planar shaped laser beams intersecting each other, the first and second vertically orientated, intersecting, and arranged at a measurable fixed angle to each other, the first planar shaped laser beam being perpendicular to a target line passing through the club face and ball, and wherein the third planar shaped laser beam intersects the first and second planar shaped laser beams at a non-vertical angle.

39. The system according to claim 38, wherein the characteristic value for club head movement comprises a value selected from the group consisting of loft angle, face angle, toe-heel angle, slice velocity, hook velocity, chop velocity, golf club head velocity, and sweet spot.

40. A golf swing analysis system useful in determining direction and magnitude coordinates for six degrees of freedom of a golf club head as it moves through a golf ball impact zone, the system comprising:

a laser source which broadcasts first and second planes of light vertically oriented and intersecting at a predetermined angle, and a third plane of light non-vertically oriented and intersecting the first and second planes of light at a predetermined angle, the first plane of light directed towards a golf ball to be struck and oriented perpendicular to a desired target line for the golf ball;

an optical receiver carried by the club shaft proximate the club head, the optical receiver having at least four optical sensors orthogonally positioned with at least three of the optical sensors defining a sensing plane;

a trigger input module which receives a detection signal from each of the optical sensors as each sensor passes through the sensing plane;

a counter module operable with the trigger module for receiving the detection signal and monitoring the number of counts between the detection signals; and a processor communicating with the counter module for calculating a value for golf club head movement and orientation.

41. The system according to claim 40, wherein the value for golf club head movement and orientation is selected from the value consisting of loft angle, face angle, toe-heel angle, golf swing slice velocity, golf swing hook velocity, golf swing chop velocity, golf club head lateral position with respect to a golf ball, golf club head height position with respect to a golf ball, and golf club head velocity.

42. The system according to claim 41, further comprising a display for displaying the value.

43. A method for analyzing a golf swing comprising the steps of:

providing a plane of radiation through which radiation plane a golf club can pass;

placing a radiation sensor on the golf club, the radiation sensor responsive to an orientation of a ball striking face of a golf club head , wherein the radiation sensor comprises a radiation receiver having a plurality of radiation sensors orthogonally arranged at measurable preselected locations with at least three of the plurality of radiation sensors defining a radiation sensor plane, the radiation sensor plane representative of the striking face of the club head;

providing a radiation sensing signal from the sensor responsive to first and second portions of the golf club head passing through the plane of radiation;

timing the radiation sensor as it passes through the plane of radiation;

providing radiation sensing signals as the sensor passes through the plane of radiation;

measuring a time period between passage of first and second portions of the head through the radiation plane; and calculating a characteristic value for club head movement through a ball impact zone from the time period measurements.

44. The method according to claim 43, further comprising the step of transmitting the time period to a processor for completing the calculating step.

45. The method according to claim 44, wherein the transmitting step comprises the step of using a radio frequency transmission and reception.

46. The method according to claim 43, wherein the step of providing a plane of radiation comprises the steps of:

providing a fan shaped laser beam; and placing the beam generally perpendicular to a surface upon which a player stands for swinging the golf club.

47. The method according to claim 46, further comprising the step of extending the laser beam from the player to a golf ball to be struck in direction perpendicular to a target line passing through the club face and the golf ball toward a target.

48. The method according to claim 43, wherein each radiation sensor comprises an optical sensor responsive to a laser beam.

49. The method according to claim 43, wherein the timing step comprises the steps of:

triggering a pulsed output indicative of the time period between passage of the first and second locations passing the radiation plane;

counting a number of pulses between the radiation sensor signals; and transmitting the counts to a processor.

50. The method according to claim 43, wherein the characteristic value for club head movement comprises a value selected from the group consisting of loft angle, face angle, and golf club head velocity.

51. The method according to claim 43, further comprising the step of displaying the characteristic value.

52. The method according to claim 43, wherein the radiation plane comprises first and second fan shaped laser beams intersecting each other and each vertically orientated and arranged at a measurable fixed angle to each other, and wherein the first fan shaped laser beam is perpendicular to a target line passing through the club face and ball.

53. The method according to claim 52, wherein the characteristic value for club head movement comprises a value selected from the group consisting of loft angle, face angle, toe-heel angle, slice velocity, hook velocity, and golf club head velocity.

54. A method for analyzing a golf swing comprising the steps of:

providing a plane of radiation through which radiation plane a golf club can pass, wherein the radiation plane comprises first, second, and third planar shaped laser beams intersecting each other, the first and second vertically orientated, intersecting, and arranged at a measurable fixed angle to each other, the first planar shaped laser beam being perpendicular to a target line passing through the club face and ball, and wherein the third planar shaped laser beam intersects the first and second planar shaped laser beams at a non-vertical angle;

placing a radiation sensor on the golf club, the radiation sensor responsive to an orientation of a ball striking face of a golf club head;

providing a radiation sensing signal from the sensor responsive to first and second portions of the golf club head passing through the plane of radiation;

timing the radiation sensor as it passes through the plane of radiation;

providing radiation sensing signals as the sensor passes through the plane of radiation;

measuring a time period between passage of first and second portions of the head through the radiation plane; and calculating a characteristic value for club head movement through a ball impact zone from the time period measurements.

55. The system according to claim 54, wherein the characteristic value for club head movement comprises a value selected from the group consisting of loft angle, face angle, toe-heel angle, slice velocity, hook velocity, chop velocity, golf club head velocity, and sweet spot.

56. A motion analysis system comprising:

an optical sensor responsive to a light beam for detection thereof as the light beam interact with the optical sensor, the optical sensor having at least three sensing portions defining a sensing plane;

a radiation source for emitting the light beam, wherein the light beam forms first, second, and third radiation planes through which radiation planes the optical sensor passes, and wherein the first and second radiation planes are vertically oriented and intersecting at a preselected angle, the third radiation plane intersecting the first and second radiation planes at a non-vertical orientation, and the first radiation plane is positioned perpendicular to a target line, along which target line the optical sensor travels; and a timer for determining a time of detection of the light beams by the optical sensor, the at least three sensing portions each providing a sensing signal to the timer responsive to an interaction with the radiation plane, and wherein an orientation of the radiation plane is determined relative to the sensing plane.

57. The system according to claim 56, further comprising a processor operable with the timer for processing the sensing signals and providing a characteristic value for the sensing plane relative to the radiation plane.

58. The system according to claim 57, further comprising a transmitter operable with the timer for transmitting a communications signal representative of the characteristic value, and a receiver operable with the processor for receiving the communications signal.

59. The system according to claim 56, wherein the orientation provides a characteristic value representative of club head orientation while striking of a golf ball, the characteristic value selected from the group consisting of loft angle, face angle, and golf club head velocity.

60. The system according to claim 56, wherein the optical sensor is carried by a golf club, and wherein the sensing plane is representative of a striking face of a golf club head.

61. The system according to claim 56, further comprising a laser source for emitting the light beam as a fan shaped laser beam forming the radiation plane.

62. The system according to claim 56, further characterized by at least two radiation planes, the light beam forming a first radiation plane and a second light beam forming a second radiation plane, the second radiation plane intersecting the first radiation plane, and wherein the first radiation plane is positioned perpendicular to a target line along which target line the golf club head travels.

63. The system according to claim 62, wherein the orientation provides a characteristic value representative of club head orientation while striking of a golf ball, the characteristic value selected from the group consisting of loft angle, face angle, toe-heel angle, slice velocity, hook velocity, and golf club head velocity.

64. The system according to claim 56, wherein the orientation provides a characteristic value representative of a club head orientation while striking of a golf ball, the characteristic value selected from the group consisting of loft angle, face angle, toe-heel angle, slice velocity, hook velocity, chop velocity, golf club head velocity, and sweet spot.

65. The system according to claim 56, wherein the timer comprises:

a trigger input module receiving the sensing signal and providing a pulsed output indicative of a time period between passage of each of the at least three sensing portions through the radiation plane;

a counter operable with the trigger input module for receiving the pulsed output therefrom and counting a number of pulses within the time period; and a data queue operable with the counter for storing the number of pulses counted for transmission to processor.

66. A method for determining a relative orientation of a plane during movement thereof, the method comprising:

emitting a light beam:

forming the light beam into at least three radiation planes, the light beam forming a first radiation plane, a second radiation plane, and a third radiation plane, wherein the first and second radiation planes are vertically oriented and intersecting at a preselected angle, and wherein the third radiation plane intersects the first and second radiation planes at a non-vertical orientation, the first radiation plane positioned perpendicular to a target line, which target line the orientation plane travels, and wherein the processing provides a characteristic value representative orientation plane orientation;

providing at least three sensing locations for defining a sensing plane, the at least three sensing locations each providing a time sensitive sensing signal responsive to an interaction with the radiation plane;

sensing the light beam during movement through the sensing plane, the time sensitive sensing signals in combination providing an orientation of the sensing plane relative to the radiation plane during movement relative thereto; and determining a time interval for the movement thereof.

67. The method according to claim 66, further comprising a processing of the time sensitive sensing signals and providing a characteristic value for the sensing plane relative to the radiation plane.

68. The method according to claim 66, further comprising vertically orienting the radiation plane perpendicular to a target line and representing a striking face of a golf club head by the sensing plane, wherein the processing provides the characteristic value representative of club head orientation while striking of a golf ball positioned within the target line, the characteristic value selected from the group consisting of loft angle, face angle, and golf club head velocity.

69. The method according to claim 66, further comprising at least two radiation planes, the light beam forming a first radiation plane and a second light beam forming a second radiation plane, the second radiation plane intersecting the first radiation plane, and wherein the first radiation plane is positioned perpendicular to a target line, along which target line the golf club head travels, and wherein the processing provides a characteristic value representative of club head orientation while striking of a golf ball, the characteristic value selected from the group consisting of loft angle, face angle, toe-heel angle, slice velocity, hook velocity, and golf club head velocity.

70. The method according to claim 66, wherein determining the time comprises:

receiving the sensing signal and providing a pulsed output indicative of a time period between passage of each of the at least three sensing portions through the radiation plane;

counting a number of pulses within the time; and storing the number of pulses counted for transmission and processing thereof.

71. The method according to claim 66, wherein forming the radiation plane includes emitting a fan shaped laser beam from a laser source.

* * * * *